US008915377B2

(12) United States Patent
Gandhi

(10) Patent No.: US 8,915,377 B2
(45) Date of Patent: Dec. 23, 2014

(54) METHOD AND APPARATUS FOR SORTING FIBERS

(75) Inventor: Umesh N. Gandhi, Farmington Hills, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 214 days.

(21) Appl. No.: 13/528,914

(22) Filed: Jun. 21, 2012

(65) Prior Publication Data

US 2013/0340510 A1 Dec. 26, 2013

(51) Int. Cl.
*B07C 5/02* (2006.01)

(52) U.S. Cl.
USPC ..... 209/539; 209/315

(58) Field of Classification Search
CPC ..... B07B 1/00; B07C 1/02; B07C 1/06; B07C 1/18
USPC ..... 209/3, 17, 538, 539, 540, 551, 315, 906
See application file for complete search history.

(56) References Cited

U.S. PATENT DOCUMENTS 5,017,312 A 5/1991 Peters et al.
5,196,212 A * 3/1993 Knoblach ..... 425/174.8 R
5,298,203 A * 3/1994 Yoshida et al. ..... 264/439
5,846,356 A 12/1998 Vyakarnam et al.
5,873,973 A * 2/1999 Koon et al. ..... 156/272.4
6,025,285 A 2/2000 Vyakarnam et al.
6,925,857 B2 8/2005 Weber et al.
8,491,292 B1 * 7/2013 Imholt et al. ..... 425/174.6
8,580,181 B1 * 11/2013 Beachley et al. ..... 264/465
2012/0015171 A1 * 1/2012 Hull et al. ..... 428/221
2013/0341837 A1 * 12/2013 Gandhi ..... 264/437

OTHER PUBLICATIONS

R. Bharadwaj, A. Patel, S. Chokdeepanich, and G. G. Chase, "Oriented Fiber Filter Media", Journal of Engineered Fibers and Fabrics, Special Issue 2008—Filtration; The University of Akron, Ohio, Microscale Physiochemical Engineering Center, Department of Chemical and Biomolecular Engineering; http://www.jeffjournal.org.

* cited by examiner

*Primary Examiner* — Joseph C Rodriguez
(74) *Attorney, Agent, or Firm* — Christopher G. Darrow; Young Basile Hanlon & MacFarlane P C

(57) ABSTRACT

A method of determining the length distribution in the population of glass or plastic fibers in, for example, a fiber reinforced polymeric article wherein the fibers recovered from a representative article are immersed in a non-polar liquid and the combination of the liquid and fibers is passed through a sieve stack while an applied high electric field produces a relatively uniform alignment of the fibers as they pass through the sieves thereby improving the accuracy of the filtering process.

10 Claims, 1 Drawing Sheet

FIG. 1
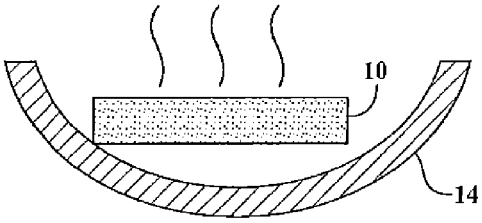
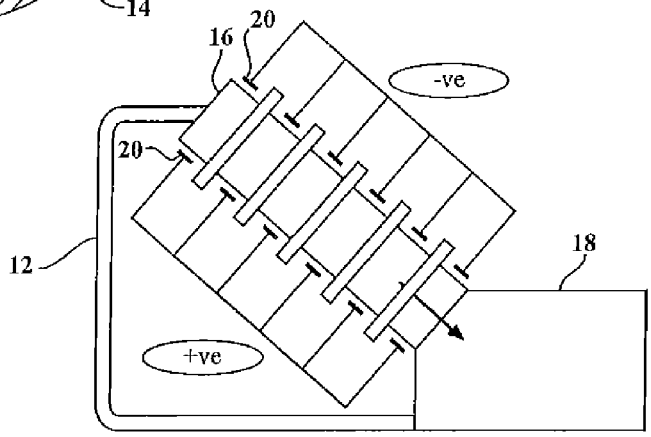
FIG. 2
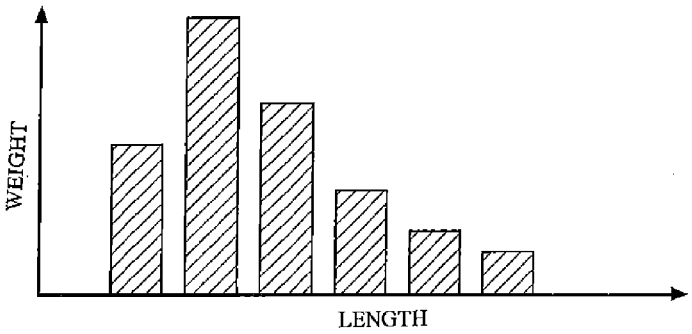
FIG. 3
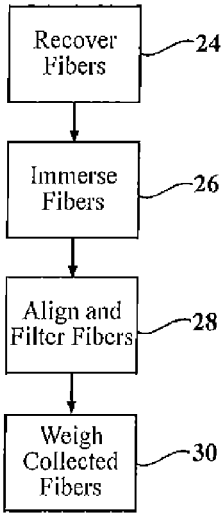
FIG. 4

METHOD AND APPARATUS FOR SORTING FIBERS

FIELD OF THE INVENTION

This document discloses a method and apparatus for determining the distribution of fiber lengths in the population of fibers used to construct fiber reinforced polymeric articles.

BACKGROUND OF THE INVENTION

Fiber reinforced plastics are composite materials consisting of a polymer matrix reinforced with fibers like glass, carbon, or plastic. A polymer without fiber reinforcement can be relatively weak. Many plastic articles are reinforced with fibers to improve strength, rigidity, impact resistance and other physical properties. Factors determining the desired properties include fiber length and the distribution of lengths in the fiber population. Therefore, it can be important to persons involved in the manufacture of such fiber reinforced articles to determine the distribution of fiber lengths in a given product. This can be done by recovering the fibers from a product sample and determining the fiber length distribution in the fiber population.

It is known to sort fibers according to length through the use of sieves of a woven construction as shown, see for example, U.S. Pat. No. 6,925,857 ('857) the entire disclosure of which is incorporated herein by reference. The sieves in that patent are designed to collect and sort fibers according to size. In the '857 disclosure, a sample composite article is first heated to "burn-off" the polymer leaving behind the reinforcing fibers. The reinforcing fibers are then grouped according to their length using a fiber separator. The fiber separator comprises a series of sieves each with a screen. The cross-section of a screen is constructed to retain fibers of a predetermined length, and to pass fibers smaller than that predetermined length to another sieve with a screen with still smaller screen openings. In this manner, longer reinforcing fibers are trapped by the uppermost coarse screen, while successively shorter reinforcing fibers are captured by the successively finer screens. Each sieve is weighed individually to calculate the distribution of the fiber lengths in the sample.

In operation, the fibers are suspended in a liquid, and the fiber solution is passed through the fiber separator. However, because the fibers are randomly oriented in the liquid, the accuracy of the sorting process is not optimum; i.e., longer fibers may pass through a sieve if oriented diagonally to a sieve opening while shorter fibers are caught by the same sieve.

SUMMARY OF THE INVENTION

According to one aspect, the invention provides a method of more accurately determining the length distribution in the population of fibers in a fiber reinforced polymeric (FRP) article. In an illustrative embodiment hereinafter described in detail, the fibers in an article of interest are recovered by first separating the fibers from the polymer matrix, typically done by heating. The recovered fibers are thereafter placed in a non-polar liquid, such as silicone oil, and aligned by the application of a high electric field, such as a DC field, while at the same time the fibers are passed through a stack of sieves with progressively smaller filter openings where the aligned fibers are more efficiently and accurately collected and sorted as to length. The different lengths may thereafter be quantified by weighing the content of each sieve and the resulting information used to improve control of the physical characteristics of similarly molded articles through appropriate selection of fiber lengths.

According to another aspect, the invention provides an apparatus for sorting fibers immersed in non-polar liquid. The apparatus comprises a stack of sieves with progressively smaller opening sizes, a circuit for pumping the liquid/fiber mix through the stack, and means for applying an electric field to at least some of the filters in the stack thereby to align the fibers in a predetermined direction during the filtering step.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter being briefly described hereinafter.

BRIEF SUMMARY OF THE DRAWINGS

The description herein makes reference to the accompanying drawings wherein like reference numerals refer to like parts throughout the several views and wherein:

FIG. 1 is a representation of heat to recover glass reinforcing fibers from a fiber reinforced polymeric article.

FIG. 2 is a diagram of a representative apparatus for carrying out the method invention;

FIG. 3 is a chart showing representative distribution of the population by weight of fibers of different length in an article under examination; and FIG. 4 is a flow chart of the method carried out using the present invention.

DETAILED DESCRIPTION OF THE ILLUSTRATIVE EMBODIMENT

Referring to FIG. 1, an FRP article 10 to be evaluated is placed in a crucible 14 or other suitable vessel and heated to separate the polymer from the reinforcing fibers in the article 10. The article 10 may, for example, be fiber-reinforced polymeric rear lift gate for an automotive vehicle, a door handle component or any other FRP article.

Referring to FIG. 2, a sieve stack 16 is connected in a fluid circuit 12 for a mix consisting of fibers collected from the step of FIG. 1. in a non-polar liquid such as silicone oil, turpentine, benzene, carbon tetrachloride, diethyl ether or any other organic solvents. The circuit includes a reservoir 18. The mix of non-polar liquid and fibers is caused to pass through filter stack 16 by appropriate means, such as pumping. A high electric field is applied by electrodes 20 arranged, in this case, across each stage of the sieve stack 16. The electrodes are located in a fixed and constant fashion with respect to the orientation of the openings in each sieve. The field is preferably DC and in the strength range of about 1-5 kV per mm length of the electrodes 20 for the grading of fibers having an average length between 4 and 7 mm and an aspect ratio of approximately 100. The sieves in the stack 16 are of a woven construction as shown in U.S. Pat. No. 6,925,857 and have progressively smaller filter openings so that the highest or first encountered sieve in the stack 16 collects longer fibers and the subsequent sieves in the stack 16 collect smaller and smaller fibers, the number of sieves and the increments of size being selected according to the known or expected distribution of lengths in the fiber population.

While the electrodes 20 are shown as flat in FIG. 2, this is merely representative of one possible shape as used with sieves of rectangular geometry where a fairly uniform parallel alignment of fibers results. For circular or oval sieves, the electrode set may comprise a perimeter electrode and a center electrode, in which case the fiber alignment becomes radial.

The filtering sieves are thereafter removed from the stack 16 and the collected fibers are quantified by weighing. A typical distribution is shown in FIG. 3.

Referring to FIG. 4, the steps of the method are summarized as follows. In step 24, the fibers in a reinforced polymeric article are recovered by heating and physical separation. In step 26, the fibers are immersed in a non-polar fluid as selected from the group described above. In step 28, the immersed fiber and non-polar liquid are together passed through the filter or sieve stack 16 while the high electric field is applied to cause a relatively uniform alignment of the fibers as they pass through the openings of the progressively smaller sieves in the stack 16. This step is selective; i.e., a different voltage may be used in each zone immediately before the filter. This helps to control the fiber orientation as desired in each zone. Typically, the fiber orientations can be manipulated in each zone to get consistent filtering action. In step 30, the sieves are removed from the stack, the fibers are removed from the sieves and weighed to determine the components of the overall length distribution by weight.

In the preferred case, the sieves are arranged with the networks of filtering elements all aligned the same way. With this arrangement, the electric fields are all unidirectional.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A method of determining the length distribution of fibers in a collection of fibers comprising the steps of:

immersing the fibers in a non-polar liquid;

passing the fibers in the non-polar liquid through a stack of sieves in a fluid flow pass wherein each sieve represents and collects a different progressively shorter fiber length while, at the same time, applying an electric field to immersed fibers prior to passing the fibers in the non-polar liquid through the sieves; and quantifying the collected fibers in each sieve in the stack.

2. A method as defined in claim 1 wherein the non-polar liquid is selected from the group consisting of organic solvents, turpentine and silicone oil.

3. A method as defined in claim 1 wherein the electric field is DC with a strength about 1 and 5 kV per mm of electrode length.

4. A method as defined in claim 1 wherein the fibers are collected by recovering the fibers from a previously molded fiber-reinforced polymeric article.

5. A method as defined in claim 1 wherein an electric field is applied to the immersed fibers prior to at least two sieves.

6. Apparatus for sorting fibers recovered from a fiber-reinforced plastic article comprising:

a stack of sorting sieves with progressively graduated filtering sizes;

a fluid circuit coupled to the stack, the fluid circuit creating a flow of a mix of fibers in a non-polar liquid through the stack; and electrodes coupled to the stack of sieves, the electrodes applying an electric field to at least one location in the stack to align the fibers in a predetermined direction relative to each sieve while the mix of fibers in the non-polar liquid is flowing through the stack.

7. Apparatus for sorting fibers recovered from a fiber-reinforced plastic article comprising:

a stack of sorting sieves with progressively graduated filtering sizes;

a fluid circuit coupled to the stack, the fluid circuit creating a flow of a mix of fibers in a non-polar liquid through the stack; and electrodes coupled to the stack of sieves, the electrodes applying an electric field to at least one location in the stack to align the fibers in a predetermined direction relative to each sieve while the mix of fibers in the non-polar liquid is flowing through the stack; and wherein electric fields applied to at least two sieves are different.

8. Apparatus as defined in claim 6 wherein:

the electrodes coupled to the stack of sieves apply an electric field to at least two sieves.

9. A method as defined in claim 5 wherein the electric fields applied to the immersed fibers prior to at least two sieves are different.

10. A method as defined in claim 1 wherein the step of passing the fibers through a stack of sieves comprises:

coupling a fluid circuit to the stack of sieves to pass the fibers through the stack of sieves by an axial flow of the fibers immersed in the non-polar liquid through the entire stack of sieves.

* * * * *